United States Patent [19]

Wilson

[11] Patent Number: 4,513,593

[45] Date of Patent: Apr. 30, 1985

[54] LOCK ARRANGEMENT

[76] Inventor: Norman H. Wilson, 8 Charnwood Rd., St. Kilda, Victoria, Australia, 3122

[21] Appl. No.: 439,273

[22] Filed: Nov. 4, 1982

[30] Foreign Application Priority Data

Apr. 28, 1982 [AU] Australia ..... PF3763

[51] Int. Cl.[3] ..... E05B 63/14; E05C 7/00

[52] U.S. Cl. ..... 70/114; 70/DIG. 11; 282/4; 282/DIG. 21

[58] Field of Search ..... 70/114, 116, DIG. 11, 70/DIG. 65, 113, 118, 120, 121, 123; 292/4, 44, 54, 153, 210, DIG. 21, DIG. 32

[56] References Cited

U.S. PATENT DOCUMENTS 2,953,916 9/1960 Thomas ..... 292/153

3,906,759 9/1975 Schwing ..... 292/4

4,178,024 12/1979 Wagner ..... 292/57

*Primary Examiner*—Robert L. Wolfe

*Attorney, Agent, or Firm*—Dennison, Meserole, Pollack & Scheiner

[57] ABSTRACT

A locking arrangement for double gates whereby one or both gates may be conveniently locked against opening. The arrangement uses an extended vertical bolt on one gate and a conventional type latching bar on the other. A latch plate is adapted to receive a projection at the top end of the bolt and the latching bar for the purpose of retaining both in a locked condition using a single lock or just the projection for retaining only the bolt in a locked condition. A lock mechanism on each side of the gates is adapted to actuate a mechanism for retaining the latching bar and/or projection in the latch plate. The arrangement allows one gate to be unlocked for pedestrian traffic while the other is locked to prevent passage of large articles through the gates.

9 Claims, 7 Drawing Figures

LOCK ARRANGEMENT

Figure 1:
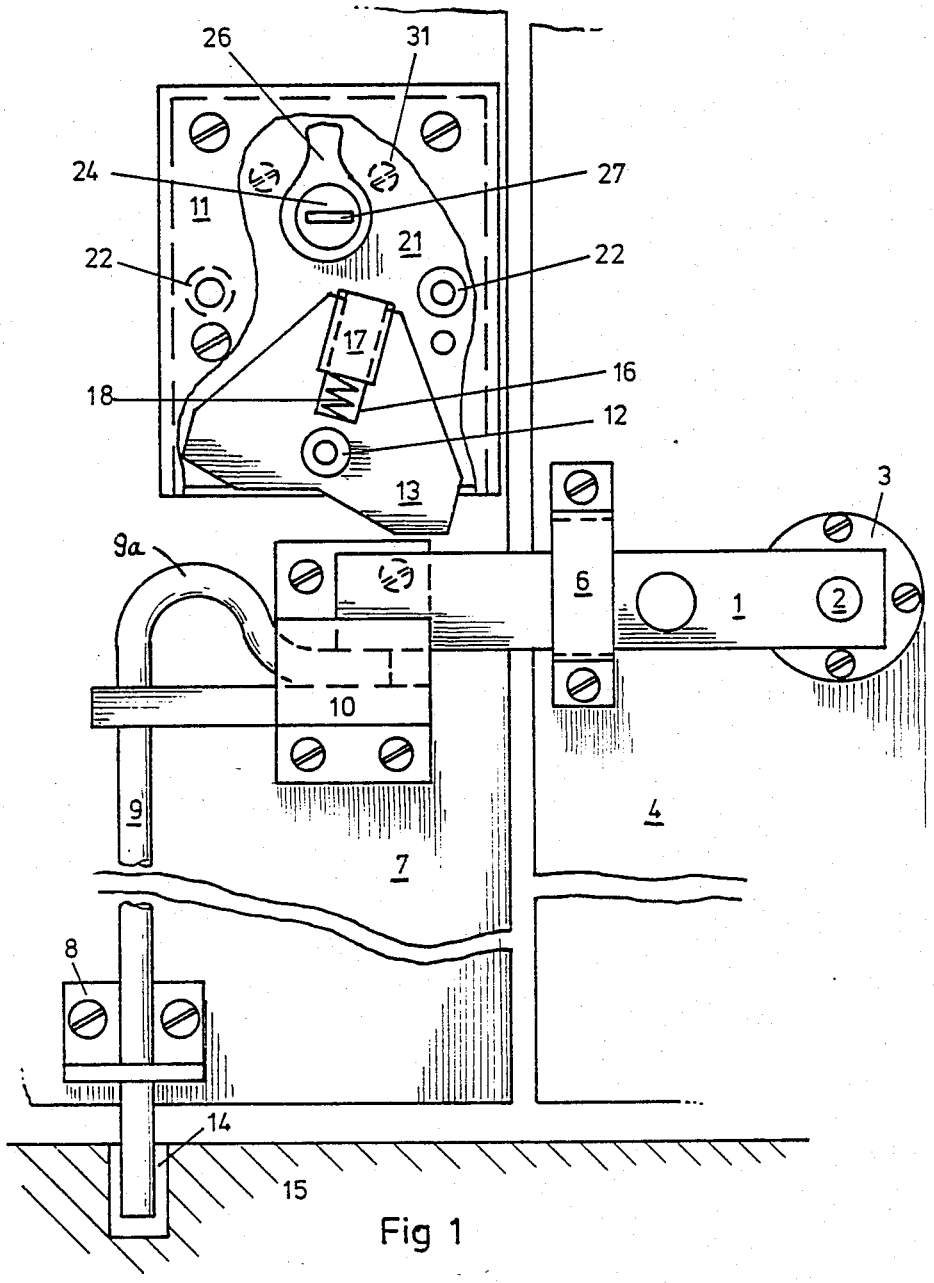

The present invention relates to locks and more particularly to a locking arrangement for double gates, or double doors wherein one gate or door closes onto the other.

In a double gate arrangement for example, one gate of the pair is usually held in a closed position by a vertical bolt engaging with a hole in the driveway and the other gate, normally used for pedestrian traffic, is held in the closed position by latching it to the first mentioned gate. Conventionally, if for security reasons a key operated lock is required, the two gates are locked together at their abutting or adjoining edges. For example, in a most basic form the lock may comprise a padlock which engages a loop on one gate which is passed through a slot in a hinged plate on the other gate. In a more sophisticated form the lock may comprise a deadbolt type lock of the kind wherein a plurality of loop type projections of a first part mounted on one gate, mesh with corresponding cut-outs in a second part mounted on the other gate and pins or rods on the second part hold the two parts together when a locking mechanism in the second part is key operated.

A number of difficulties arise with both the aforementioned locking arrangements. For example, the padlock arrangement can only be operated from one side of the gate and both arrangements require relatively close tolerances with the engaging parts on the respective gates. In addition both arrangements in the unlocked condition allow both gates to be opened whereby if the lock is in the unlocked condition to permit pedestrian traffic through one gate, both gates may be opened and this has the disadvantage that large objects such as trailers and cars may be moved through the gates. A second lock is required on the vertical bolt of conventional arrangements to overcome this latter disadvantage. The close tolerances required with conventional arrangements means there is insufficient clearance in the engaging parts to allow for expansion and contraction of the gates and consequently it is very often the case that the lock will jam or become inoperative.

It is therefore an object of the present invention to provide an improved locking arrangement for double gates or double doors which overcomes or reduces one or more of the aforementioned difficulties.

Accordingly the present invention provides a locking arrangement for double gates or double doors comprising a latch plate for attachment to one gate or door of a pair and adapted to receive, in a groove thereof, a latching bar pivotally attached to the other gate or door, a vertically slidable bolt member for attachment to said one gate or door and adapted in a downward position to engage a hole in a surface below said gates or doors and retain said one gate in a closed position, said bolt member having a projection adapted, in said downward position, for engagement in said groove, a locking bar adapted in a first locked position to retain said latching bar and said projection within said groove whereby both gates or doors are locked against opening and in a second locked condition to retain only said projection within said groove whereby said one gate is locked against opening, and a lock mechanism for actuating said locking bar.

Figure 2:
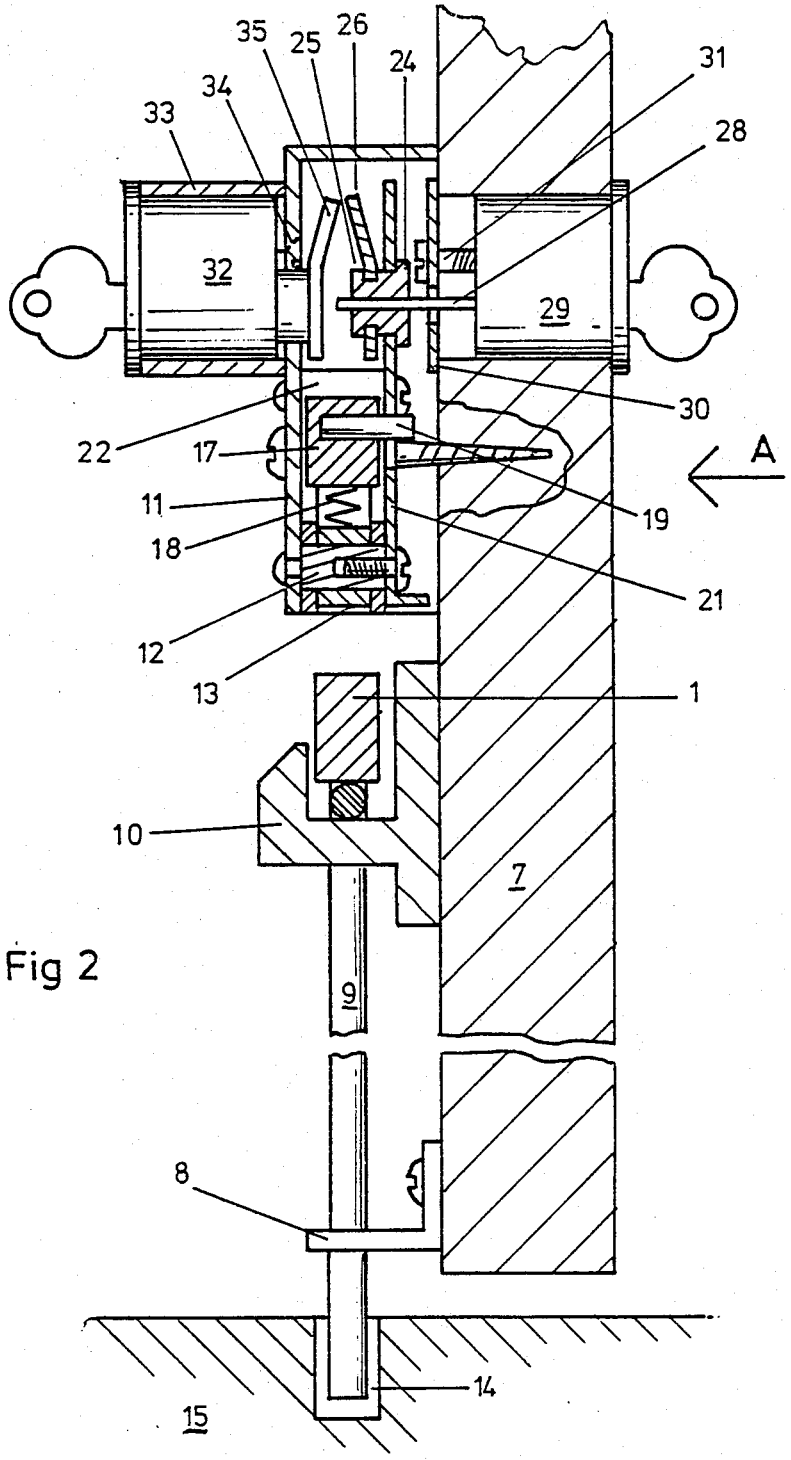
Figure 3:
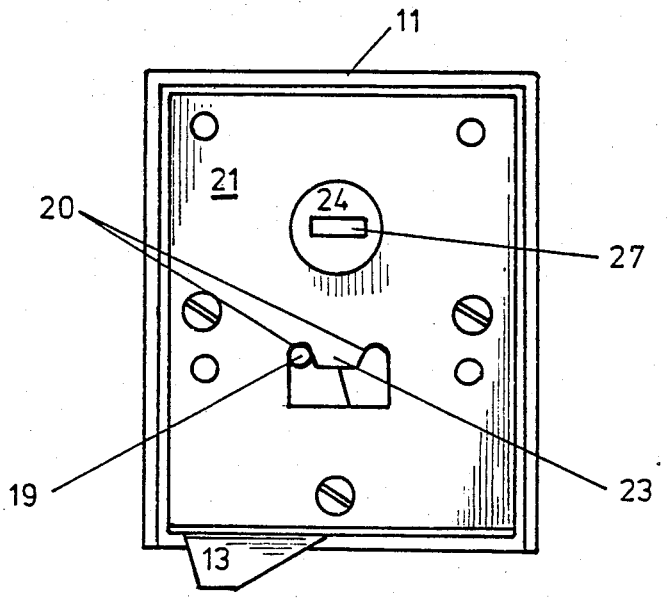
Figure 4:
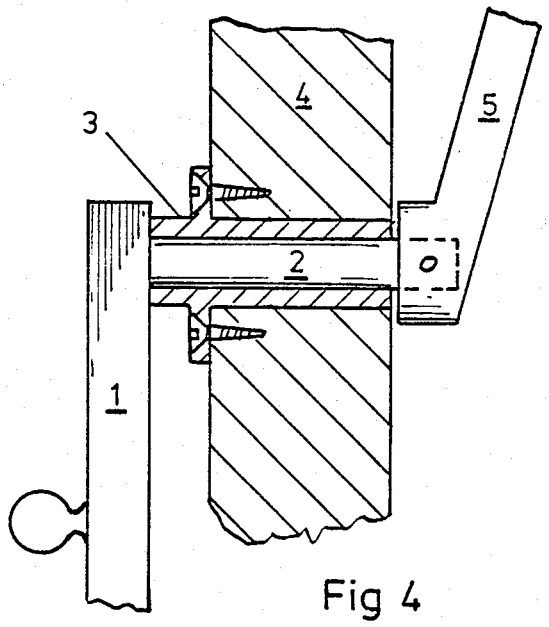
Figure 5:
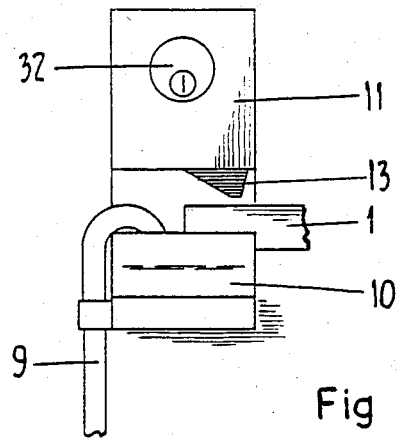
Figure 6:
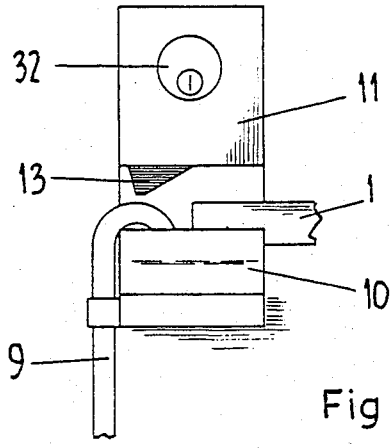
Figure 7:
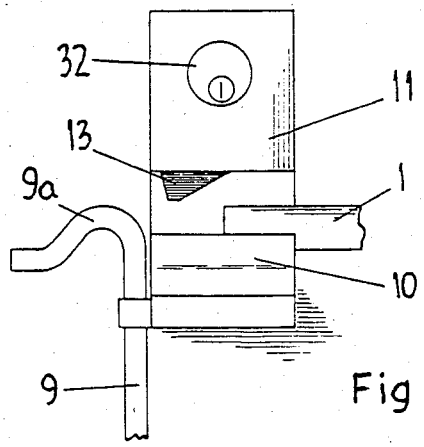

In order that the invention may be more readily understood one particular embodiment of a double gate locking arrangement will now be described with reference to the accompanying drawings wherein:

FIG. 1 is an elevation of the locking arrangement with the lock housing partly cut away, FIG. 2 is a transverse section through the locking arrangement, FIG. 3 is an elevation in the direction of the arrow A in FIG. 2, FIG. 4 is a section through the latching bar pivot, and FIGS. 5, 6 and 7 are schematic views showing the various locked conditions of the arrangement.

Referring now to the drawings, the arrangement includes a horizontal latching bar 1, of generally rectangular cross-section, secured to a rotatable pivot 2, surrounded by a flanged support bushing 3 secured to a gate 4 normally used for pedestrian traffic. The outer end of the rotatable pivot 2 on the other side of the gate 4, carries a hand lever 5 (FIG. 4) and the latching bar 1 is further restrained against substantial movement by saddle 6 secured to the gate 4.

A gate 7 which forms the other gate of a pair normally remains closed during times of pedestrian traffic and has secured to its lower part a bracket 8, which slidingly retains a vertical bolt 9 of circular cross-section. At its upper end the vertical bolt 9 is formed into the shape shown in FIG. 1 where the end is bent to extend substantially horizontally and hump 9*a* is formed for reasons which will become apparent hereinbelow. A latch plate 10 is fixed to gate 7 at a suitable height and a horizontal extension of the latch plate 10 contains a hole which forms an upper support for vertical bolt 9.

A lock housing 11 is mounted on gate 7 above latch plate 10. A pivot 12 which is rivetted to lock housing 11 supports a locking bar in the form of a rocking lever 13 having substantially horizontal extensions so disposed that one extension is above the lower edge of the lock housing 11 when the rocking lever 13 is in one extreme position of its travel, and the other extension is above the lower edge of the lock housing 11 when the rocking lever 13 is at its opposite extreme position of travel. The lock housing 11 is positioned a distance above the latching bar 1 so that when the horizontal extension of the rocking lever 13 above the latching bar 1 is in its lowest position the vertical movement of the latching bar 1 is limited, to the extent that it may not be disengaged from the latch plate 10. When the horizontal extension of the rocking lever 13 immediately above the vertical bolt 9 is in its lowest position upward movement of the vertical bolt 9 is limited by contact between the horizontal extension and the hump 9*a* to the extent that the horizontal extension of the bolt 9 may not be disengaged from the latch plate 10 and consequently bolt 9 is prevented from disengagement from hole 14 in surface 15.

Two upward extensions of the rocking lever 13 form a slot 16 into which is fitted slider 17 and flanges formed on the sides of the slider 17 bear on the side faces of the rocking lever 13 retaining the slider 17 in slot 16. A coil spring 18 holds the slider 17 in its uppermost position at all times. A peg 19 projects from the face of the slider 17 closest to the gate 7, the axis of the peg 19 being parallel with axis of rocking lever pivot 12. Peg 19 registers with one or the other of two slots 20 (FIG. 3) formed in index plate 21. The index plate 21 is secured with screws to two bosses 22 rivetted to the lock housing 11 and by one screw at the rocking lever pivot 12.

The position of the slots 20 in the index plate 21 defines the two extreme positions of the rocking lever 13 between the inner edges of the slots 20. The index plate 21 is formed with a downward projection 23 and it will be seen that when the peg 19 is registered in a slot 20, movement of the rocking lever 13 is prevented unless the slider 17 and peg 19 are forced down the slot 16 against the action of spring 18.

A hole in the upper portion of the index plate 21 forms a bearing for an actuating lever boss 24 and an extended portion 25 of the actuating lever boss 24 is rivetted over to firmly retain an actuating lever 26. It will be seen that rotation of the actuating lever boss 24 will cause the end of the actuating lever 26 to depress the slider 17 against the action of the spring 18. Downward movement of the slider will cause the peg 19 to move away from a slot 20 and further rotation of actuating lever boss 24 will cause the end of the actuating lever 26 to engage with the upper end of slot 16 in rocking lever 13. A continuation of rotation of actuating lever boss 24 will force rocking lever 13 through its arc of travel, until the actuating lever 26 disengages itself from the rocking lever 13 and slider 17 allowing the peg 19 to re-engage with the other slot 20.

A rectangular slot 27 formed on the axis of the actuating lever boss 24 accepts the back bar 28 of key operated lock cylinder 29 and retaining plate 30 and two screws 31 secure the lock cylinder 29 to gate 7.

If key locking is required from within the property to be protected a second lock cylinder 32 contained within tubular section 33 is secured to lock housing 11 by means of two countersunk screws 34. The axis of the rotatable section of lock cylinder 32 is coaxial with actuating lever boss 24. A second actuating lever 35 is fixed directly to the rotatable section of cylinder 32 and actuates the rocking lever 13 through its arc of travel in the same manner as the actuating lever 26.

In use the arrangement is fitted to double gates adjacent the adjoining or abutting edges of the gates as shown in FIG. 1. The apparatus may be provided in a kit form either with or without the latching bar 1 as in many instances an existing latching bar will work satisfactorily with the apparatus of the invention. In existing arrangements the shorter pad bolt is replaced with the bolt 9 which extends upwardly to the locking arrangement.

Once fitted the apparatus is operated as follows. Referring to FIG. 5 in order to lock both gates the upper end of the bolt 9, that is, the horizontal position thereof is located in the groove or channel formed in latch plate 10 when the gate 7 is in the closed position such that the lower end of the bolt 9 is in hole 14. In order to perform this operation the rocking lever 13 must be in the position shown in FIG. 5 and this may require actuation by a key in either of the lock cylinders 29 or 32. When the bolt 9 is in position as just described the rocking lever 13 is key operated to the position as shown in FIG. 6 and the gate 4 is closed to cause the latching bar 1 to also become located in the groove of latch plate 10. In so doing the latching bar 1 bears on the upper surface of the horizontal end portion of bolt 9 as is more clearly evident in FIG. 1. The rocking lever 13 is then key actuated to the position shown in FIG. 5 and both the latching bar 1 and bolt 9 are locked against movement out of the groove of latch plate 10. In this situation neither gate can be opened.

A second position of the locking arrangement is shown in FIG. 6 and is achieved from the position shown in FIG. 5 merely by key actuation of the rocking lever 13 to the position shown in FIG. 6. In this second position the gate 7 is locked in a closed condition but the gate 4 is free to be opened as the latching bar 1 is able to move out of the groove of latch plate 10 merely by raising same using either the knob thereon or the hand lever 5 on the opposite side of the gate 4. The situation shown in FIG. 6 is most convenient as in many situations it is desirable to have one gate locked whilst the other is free for opening and closing without a key by frequent pedestrian traffic. Thus any large mobile articles such as for example, cars, trailers and caravans may be stowed behind the gates and are unable to be removed whilst one gate remains locked. Such articles are therefore protected against theft without causing the inconvenience of having to unlock a gate each time pedestrian or other single gate traffic wishes to pass.

A third position of the locking arrangement is shown in FIG. 7 and is a condition where both gates are unlocked. This position is achieved from the position shown in FIG. 6 by firstly removing the latch 1 from the groove of latch plate 10, key actuating the rocking lever 13 to the position shown in FIG. 5 so that the end of bolt 9 may be removed from the groove and then key actuating the rocking lever 13 back to the position shown in FIG. 7.

It should be apparent from the above that the present invention provides an improved lock arrangement for double gates or double doors which conveniently allows locking of both gates or doors, locking of only one gate or door, and locking of neither. Because of the provision of latching bar 1 and latch plate 10 there is no critical tolerance between the co-operating parts and therefore movement of the gates or doors due to shrinkage or expansion does not affect the operation of the locking arrangement.

According to a modified form of the invention the index plate 21 and latch plate 10 are formed as an integral structure which conveniently set the correct spacing between the rocking lever 13 and the top edge of the latching bar 1 when the apparatus is in use. An upper support **10*a* for slidingly supporting the bolt 9 is affixed to the latch plate 10** and for convenience is affixed by screws (not shown) so that it may be reversed in situations where the bolt is on the opposite gate.

I claim:

1. A locking arrangement for double gates or double doors comprising a latch plate for attachment to one gate or door of a pair and adapted to engagingly receive a latching bar attached to the other gate or door, a vertically slidable bolt member for attachment to said one gate or door and adapted in a downward position to engage a hole in a surface below said gates or doors and retain said one gate in a closed position, said bolt member having a projection adapted, in said downward position, for engagement with said latch plate, a locking bar adapted in a first locked position to retain said latching bar and said projection in engagement with said latch plate whereby both gates or doors are locked against opening and in a second locked position to retain only said projection in engagement with said latch plate whereby said one gate is locked against opening, and a lock mechanism for actuating said locking bar.

2. A locking arrangement as defined in claim 1, characterized in that said latch plate has a groove for receiving said latching bar and said projection, and said latching bar is pivotally attached to said other gate or door.

3. A locking arrangement as defined in claim 2, characterized in that said latching bar is adapted, in use, for limited pivotal movement in a vertical plane and said projection has an end portion adapted for retention between said latching bar and said latch plate in said first locked position such that said locking bar prevents disengagement of said latching bar from said groove, which in turn prevents disengagement of said projection from said groove.

4. A locking arrangement as defined in claim 3, characterized in that said end portion is adapted in use to extend horizontally and an upwardly projecting hump portion is arranged between said end portion and said bolt, said locking bar being adapted in said second locked position to bear on said hump to retain said projection within said groove.

5. A locking arrangement as defined in claim 4, characterized in that said lock mechanism is key operable from either side of said gates or doors.

6. A locking arrangement as defined in claim 5, characterized in that said locking bar is in the form of a pivotally mounted rocking lever which in a neutral position has opposed substantially horizontal extensions, said rocking lever being pivotal to a first extreme position wherein one said horizontal extension is adapted to bear on said latching bar and to a second extreme position wherein the other said horizontal extension is adapted to bear on said hump.

7. A locking arrangement as defined in claim 6, characterized in that said rocking lever is adapted for cam operation by an actuating lever associated with said lock mechanism.

8. A locking arrangement as defined in claim 7, characterized in that each actuating lever is adapted to engage a spring biased slider mounted in a slot in said rocking lever, said slider having a projecting control pin thereon which is confined to move around a cut-out in a housing back plate so as to define the movement of said rocking lever.

9. A locking arrangement as defined in claim 8, characterized in that said back plate and said latch plate are formed as an integral structure.

* * * * *